US012043358B2

(12) United States Patent
Hasegawa et al.

(10) Patent No.: US 12,043,358 B2
(45) Date of Patent: Jul. 23, 2024

(54) OUTBOARD MOTOR

(71) Applicant: YAMAHA HATSUDOKI KABUSHIKI KAISHA, Iwata (JP)

(72) Inventors: Hiroyuki Hasegawa, Shizuoka (JP); Kensuke Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 506 days.

(21) Appl. No.: 17/375,161

(22) Filed: Jul. 14, 2021

(65) Prior Publication Data

US 2022/0106028 A1 Apr. 7, 2022

(30) Foreign Application Priority Data

Oct. 2, 2020 (JP) ..... 2020-168028

(51) Int. Cl.
*B63H 20/32* (2006.01)
*B63B 45/00* (2006.01)
*B63H 23/34* (2006.01)

(52) U.S. Cl.
CPC ..... *B63H 20/32* (2013.01); *B63B 45/00* (2013.01); *B63H 23/34* (2013.01)

(58) Field of Classification Search
CPC ..... B63H 20/32; B63H 23/34; B63B 45/00
See application file for complete search history.

(56) References Cited

U.S. PATENT DOCUMENTS 4,373,922 A * 2/1983 Weed ..... B63H 20/002 440/89 A
5,416,670 A * 5/1995 Authier ..... F21K 2/06 362/477
5,613,886 A * 3/1997 Cribbs ..... B60Q 1/305 440/2
6,200,009 B1 * 3/2001 Schulte ..... B60Q 1/30 362/540
8,803,711 B1 * 8/2014 Gonring ..... H05B 47/155 340/987
2010/0208471 A1 * 8/2010 Sell ..... F21V 21/04 362/365

* cited by examiner

*Primary Examiner* — Stephen P Avila
(74) *Attorney, Agent, or Firm* — Keating & Bennett, LLP

(57) ABSTRACT

A drive unit rotates a propeller shaft and is accommodated in a housing. A mount is provided on the housing. A light unit is attached to the mount and includes light sources. A controller is connected to the light unit, and is configured or programmed to turn on the light sources in a lighting pattern depending on an operating state of the outboard motor.

17 Claims, 15 Drawing Sheets

OUTBOARD MOTOR

CROSS REFERENCE TO RELATED APPLICATIONS

This application claims the benefit of priority to Japanese Patent Application No. 2020-168028 filed on Oct. 2, 2020. The entire contents of this application are hereby incorporated herein by reference.

BACKGROUND OF THE INVENTION

1. Field of the Invention

The present invention relates to an outboard motor.

2. Description of the Related Art

There is a type of outboard motor embedded with a light unit for informing a person or people, swimming in the surroundings of a watercraft, of an operating state of the outboard motor. The light unit is turned on in a lighting pattern depending on the operating state of the outboard motor. For example, U.S. Pat. No. 8,803,711 describes a display system that includes an indicator device and a controller. The indicator device includes a plurality of light sources. The controller turns on the light sources in a lighting pattern depending on the operating state of the outboard motor such as an engine-cranking state, an engine-running state, a forward movement, or a reverse movement.

U.S. Pat. No. 8,803,711 describes that the indicator device is attached to the stern of the watercraft or the rear surface of the outboard motor. However, U.S. Pat. No. 8,803,711 does not disclose any structure for attaching the indicator device to the outboard motor.

SUMMARY OF THE INVENTION

Preferred embodiments of the present invention relate to a structure to attach a light unit to an outboard motor.

An outboard motor according to a first aspect of a preferred embodiment of the present invention includes a propeller shaft, a drive unit, a housing, a mount, a light unit, and a controller. The drive unit rotates the propeller shaft. The housing accommodates the drive unit. The mount is provided on the housing. The light unit is attached to the mount and includes a plurality of light sources. The controller is connected to the light unit. The controller is configured or programmed to turn on the plurality of light sources in a lighting pattern depending on an operating state of the outboard motor.

An outboard motor according to a second aspect of a preferred embodiment of the present invention includes a propeller shaft, a drive unit, a housing, a mount, and a cover. The drive unit rotates the propeller shaft. The housing accommodates the drive unit. The mount is provided on the housing to attach thereto a light unit that is capable of being turned on in a lighting pattern depending on an operating state of the outboard motor. The cover is attached to the housing to cover the mount.

An outboard motor according to a third aspect of a preferred embodiment of the present invention includes a propeller shaft, a drive unit, a housing, an exhaust pathway, a mount, a light unit, and a controller. The drive unit rotates the propeller shaft and includes an engine. The housing accommodates the drive unit. The exhaust pathway is connected to the engine. The exhaust pathway includes an exhaust port exposed from the housing to an outside of the outboard motor. The mount is provided on the housing and is located above the exhaust port. The light unit is attached to the mount and includes a plurality of light sources. The controller is connected to the light unit. The controller is configured or programmed to turn on the plurality of light sources in a lighting pattern depending on an operating state of the outboard motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
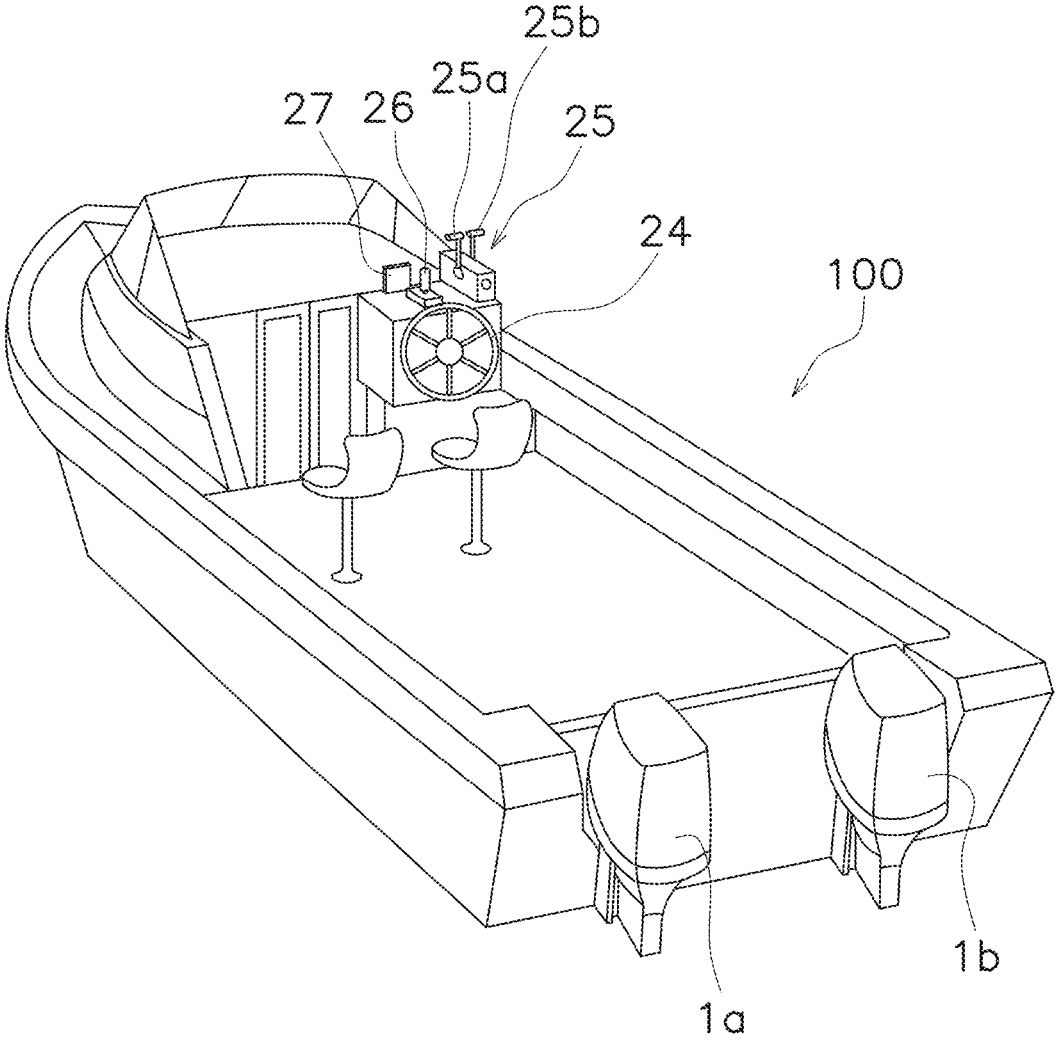
FIG. 1 is a perspective view of a watercraft to which an outboard motor according to a first preferred embodiment of the present invention is mounted.

Preferred embodiments of the present invention will be hereinafter explained with reference to drawings. FIG. 1 is a perspective view of a watercraft 100 to which at least one outboard motor according to a first preferred embodiment of the present invention is mounted. The watercraft 100 includes a plurality of outboard motors 1*a* and 1*b*.

The outboard motors 1*a* and 1*b* are attached to the stern of the watercraft 100. The outboard motors 1*a* and 1*b* are aligned in a width direction of the watercraft 100. Specifically, the outboard motor 1*a* is located on the port side of the watercraft 100. The outboard motor 1*b* is located on the starboard side of the watercraft 100. Each outboard motor 1*a*, 1*b* generates a thrust to propel the watercraft 100.

Figure 2:
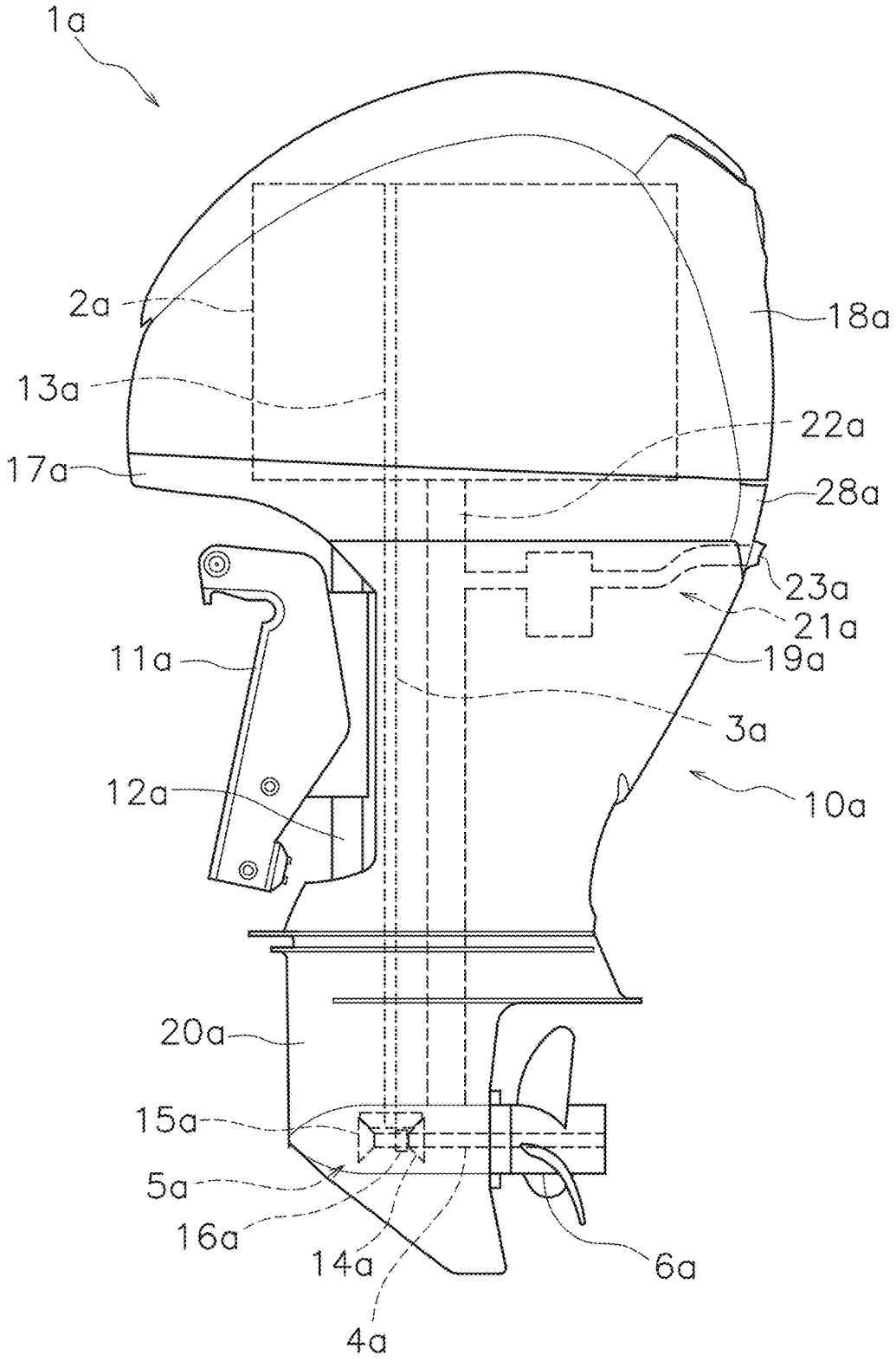
FIG. 2 is a side view of the outboard motor.

FIG. 2 is a side view of the outboard motor 1*a*. A structure of the outboard motor 1*a* will be hereinafter explained. However, the outboard motor 1*b* is also similar in structure to the outboard motor 1*a*. The outboard motor 1*a* is attached to the watercraft 100 through a bracket 11*a*. The bracket 11*a* supports the outboard motor 1*a* such that the outboard motor 1*a* is rotatable about a steering shaft 12*a*. The steering shaft 12*a* extends in an up-and-down direction of the outboard motor 1*a*.

It should be noted that in the present preferred embodiment, a side on which the bracket 11*a* is located on the outboard motor 1*a* is defined as "front", whereas an opposite side to this side is defined as "rear". In other words, a direction oriented from the outboard motor 1*a* to the watercraft 100 is defined as "forward", whereas a direction oriented from the watercraft 100 to the outboard motor 1*a* is defined as "rearward".

The outboard motor 1*a* includes a drive unit 2*a*, a drive shaft 3*a*, a propeller shaft 4*a*, and a shift mechanism 5*a*. The drive unit 2*a* generates the thrust to propel watercraft 100. The drive unit 2*a* is, for example, an internal combustion engine. The drive unit 2*a* includes a crankshaft 13*a*. The crankshaft 13*a* extends in the up-and-down direction of the outboard motor 1*a*. The drive shaft 3*a* is connected to the crankshaft 13*a*. The drive shaft 3*a* extends in the up-and-down direction of the outboard motor 1*a*. The propeller shaft 4*a* extends in a back-and-forth direction of the outboard motor 1*a*. The propeller shaft 4*a* is connected to the drive shaft 3*a* through the shift mechanism 5*a*. A propeller 6*a* is attached to the propeller shaft 4*a*.

The shift mechanism 5*a* includes a forward moving gear 14*a*, a rearward moving gear 15*a*, and a dog clutch 16*a*. When gear engagement is switched between the gears 14*a* and 15*a* by the dog clutch 16*a*, the direction of rotation transmitted from the drive shaft 3*a* to the propeller shaft 4*a* is switched. Movement of the watercraft 100 is thus switched between forward movement and rearward movement.

The outboard motor 1*a* includes a housing 10*a*. The housing 10*a* accommodates the drive unit 2*a*, the drive shaft 3*a*, the propeller shaft 4*a*, and the shift mechanism 5*a*. The housing 10*a* includes a bottom cowling 17*a*, a top cowling 18*a*, an upper casing 19*a*, and a lower casing 20*a*. The bottom cowling 17*a* covers the drive unit 2*a*. The bottom cowling 17*a* is made of resin, for example. It should be noted that the bottom cowling 17*a* may be made of metal such as aluminum. The top cowling 18*a* is located above the bottom cowling 17*a*. The top cowling 18*a* is attached to the bottom cowling 17*a*. The upper casing 19*a* is located below the bottom cowling 17*a*. The lower casing 20*a* is located below the upper casing 19*a*. The lower casing 20*a* accommodates the propeller shaft 4*a* and the shift mechanism 5*a*.

The outboard motor 1*a* includes an exhaust pathway 21*a*. Exhaust gas, released from the drive unit 2*a*, is discharged to outside the outboard motor 1*a* through the exhaust pathway 21*a*. The exhaust pathway 21*a* includes an exhaust pipe 22*a* and an exhaust port 23*a*. The exhaust pipe 22*a* is connected to the drive unit 2*a*. The exhaust pipe 22*a* is connected to the exhaust port 23*a*. The exhaust port 23*a* extends from the housing 10*a* to outside the outboard motor 1*a*. The exhaust port 23*a* is located on the rear surface of the housing 10*a*.

Figure 3:
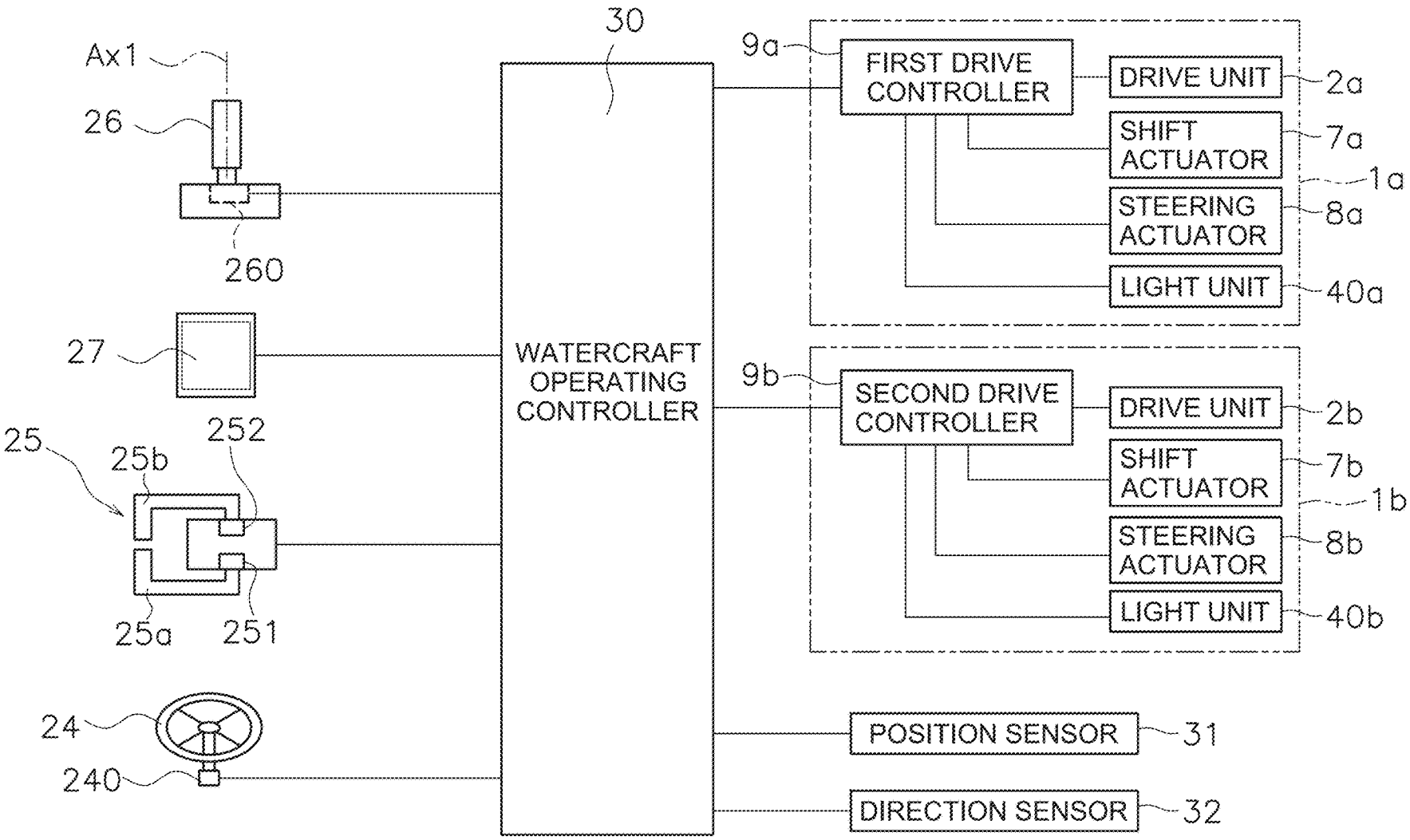
FIG. 3 is a schematic diagram showing a configuration of a watercraft operating system for the watercraft.

FIG. 3 is a schematic diagram showing a configuration of a watercraft operating system of the watercraft 100. As shown in FIG. 3, the outboard motor 1*a* includes a shift actuator 7*a* and a steering actuator 8*a*.

The shift actuator 7*a* is connected to the dog clutch 16*a* of the shift mechanism 5*a*. The shift actuator 7*a* actuates the dog clutch 16*a* so as to switch gear engagement between the gears 14*a* and 15*a*. Movement of the watercraft 100 is thus switched between forward movement and rearward movement. The shift actuator 7*a* is, for instance, an electric motor. It should be noted that the shift actuator 7*a* may be another type of actuator such as an electric cylinder, a hydraulic motor, or a hydraulic cylinder.

The steering actuator 8*a* is connected to the outboard motor 1*a*. The steering actuator 8*a* rotates the outboard motor 1*a* about the steering shaft 12*a* to change the rudder angle of the outboard motor 1*a*. The rudder angle refers to an angle of the propeller shaft 4*a* with respect to the back-and-forth direction of the outboard motor 1*a*. The steering actuator 8*a* is, for instance, an electric motor. It should be noted that the steering actuator 8*a* may be another type of actuator such as an electric cylinder, a hydraulic motor, or a hydraulic cylinder.

The outboard motor 1*a* includes a first drive controller 9*a*. The first drive controller 9*a* includes a processor such as a CPU (Central Processing Unit) and memories such as a RAM (Random Access Memory) and a ROM (Read Only Memory). The first drive controller 9*a* stores a program and data to control the outboard motor 1*a*. The first drive controller 9*a* controls the drive unit 2*a*.

The outboard motor 1*b* includes a drive unit 2*b*, a shift actuator 7*b*, a steering actuator 8*b*, and a second drive controller 9*b*. The drive unit 2*b*, the shift actuator 7*b*, the steering actuator 8*b*, and the second drive controller 9*b* in the outboard motor 1*b* are configured in similar manner to the drive unit 2*a*, the shift actuator 7*a*, the steering actuator 8*a*, and the first drive controller 9*a* in the outboard motor 1*a*, respectively.

The watercraft operating system includes a steering wheel 24, a remote controller 25, a joystick 26, and an input 27. As shown in FIG. 1, the steering wheel 24, the remote controller 25, the joystick 26, and the input 27 are located in a cockpit of the watercraft 100.

The steering wheel 24 enables an operator to operate a turning direction of the watercraft 100. The steering wheel 24 includes a sensor 240. The sensor 240 outputs a steering signal indicating an operating direction and an operating amount of the steering wheel 24.

The remote controller 25 includes a first throttle lever 25*a* and a second throttle lever 25*b*. The first throttle lever 25*a* enables the operator to regulate the magnitude of the thrust generated by the outboard motor 1*a*. Additionally, the first throttle lever 25*a* enables the operator to switch the direction of the thrust generated by the outboard motor 1*a* between forward and rearward directions. The first throttle lever 25*a* is operable from a neutral position to a forward moving directional side and a rearward moving directional side. The neutral position is a position located between the forward moving directional side and the rearward moving directional side. The first throttle lever 25*a* includes a sensor 251. The sensor 251 outputs a throttle signal indicating an operating direction and an operating amount of the first throttle lever 25*a*.

The second throttle lever 25*b* enables the operator to regulate the magnitude of the thrust generated by the outboard motor 1*b*. Additionally, the second throttle lever 25*b* enables the operator to switch the direction of the thrust generated by the outboard motor 1*b* between forward and rearward directions. The second throttle lever 25*b* is configured in similar manner to the first throttle lever 25*a*. The second throttle lever 25*b* includes a sensor 252. The sensor 252 outputs a throttle signal indicating an operating direction and an operating amount of the second throttle lever 25*b*.

The joystick 26 enables the operator to operate the movement of the watercraft 100 in each of the moving directions of front, rear, right, and left. Additionally, the joystick 26 enables the operator to operate a bow turning motion performed by the watercraft 100. The joystick 26 is tiltable from a neutral position at least in four directions of front, rear, right, and left. Four or more directions, and furthermore, all directions may be instructed by the joystick 26. The joystick 26 is turnable (twistable) about a rotational axis Ax1. In other words, the joystick 26 is twistable clockwise and counterclockwise about the rotational axis Ax1 from the neutral position.

The joystick 26 includes a sensor 260. The sensor 260 outputs a joystick signal that indicates operating the joystick 26. The joystick signal contains information regarding a tilt direction and a tilt amount of the joystick 26. The joystick signal includes information regarding a twist direction and a twist amount of the joystick 26.

The watercraft operating system includes a watercraft operating controller 30. The watercraft operating controller 30 includes a processor such as a CPU and memories such as a RAM and a ROM. The watercraft operating controller 30 stores programs and data to control the outboard motors 1*a* and 1*b*. The watercraft operating controller 30 is connected to the first and second drive controllers 9*a* and 9*b* through wired or wireless communication. The watercraft operating controller 30 is connected to the steering wheel 24, the remote controller 25, the joystick 26, and the input 27.

The watercraft operating controller 30 receives the steering signal from the sensor 240. The watercraft operating controller 30 receives the throttle signal from each sensor 251, 252. The watercraft operating controller 30 receives the joystick signal from the sensor 260. The watercraft operating controller 30 outputs a command signal to each first/second drive controller 9*a*, 9*b* based on the signals received from the sensors 240, 251, 252, and 260. The command signal is transmitted to each shift actuator 7*a*, 7*b* and each steering actuator 8*a*, 8*b* through each first/second drive controller 9*a*, 9*b*.

For example, the watercraft operating controller 30 outputs the command signal to the shift actuator 7*a* in accordance with the operating direction of the first throttle lever 25*a*. In response, shifting between forward movement and rearward movement by the outboard motor 1*a* is performed. The watercraft operating controller 30 outputs a throttle command to the drive unit 2*a* in accordance with the operating amount of the first throttle lever 25*a*. The first drive controller 9*a* controls an output rotational speed of the outboard motor 1*a* in accordance with the throttle command.

The watercraft operating controller 30 outputs the command signal to the shift actuator 7*b* in accordance with the operating direction of the second throttle lever 25*b*. In response, shifting between forward movement and rearward movement by the outboard motor 1*b* is performed. The watercraft operating controller 30 outputs a throttle command to the drive unit 2*b* in accordance with the operating amount of the second throttle lever 25*b*. The second drive controller 9*b* controls an output rotational speed of the outboard motor 1*b* in accordance with the throttle command.

The watercraft operating controller 30 outputs the command signal to each steering actuator 8*a*, 8*b* in accordance with the operating direction and the operating amount of the steering wheel 24. When the steering wheel 24 is operated leftward from the neutral position, the watercraft operating controller 30 controls each steering actuator 8*a*, 8*b* such that each outboard motor 1*a*, 1*b* is rotated rightward. The watercraft 100 thus turns leftward.

When the steering wheel 24 is operated rightward from the neutral position, the watercraft operating controller 30 controls each steering actuator 8*a*, 8*b* such that each outboard motor 1*a*, 1*b* is rotated leftward. The watercraft 100 thus turns rightward. Additionally, the watercraft operating controller 30 controls the rudder angle of each outboard motor 1*a*, 1*b* in accordance with the operating amount of the steering wheel 24.

The watercraft operating controller 30 outputs the command signals to each drive unit 2*a*, 2*b*, each shift actuator 7*a*, 7*b*, and each steering actuator 8*a*, 8*b* in accordance with the tilt direction and the tilt amount of the joystick 26. The watercraft operating controller 30 controls each drive unit 2*a*, 2*b*, each shift actuator 7*a*, 7*b*, and each steering actuator 8*a*, 8*b* such that translation (linear motion) of the watercraft 100 occurs at a velocity corresponding to the tilt amount of the joystick 26 in a direction corresponding to the tilt direction of the joystick 26.

When the joystick 26 is tilted forward, the watercraft operating controller 30 moves the watercraft 100 forward (fore surging mode). When the joystick 26 is tilted rearward, the watercraft operating controller 30 moves the watercraft 100 rearward (aft surging mode).

Figure 4:
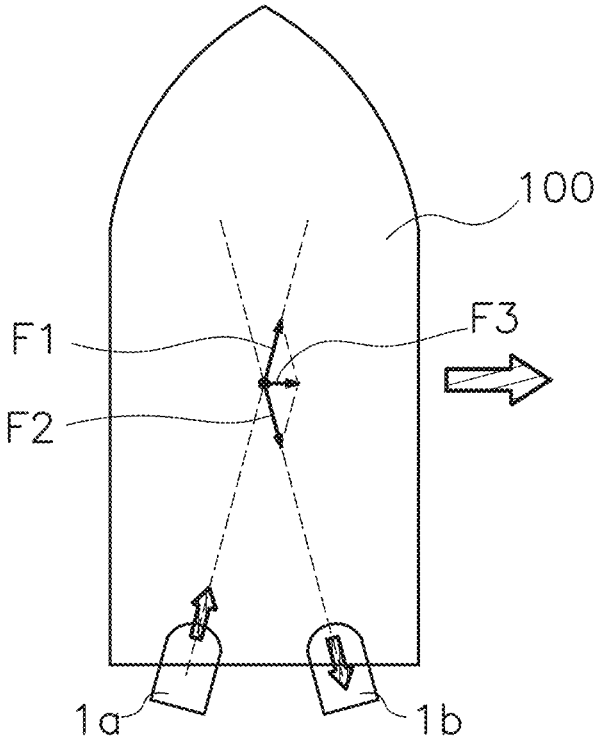
FIG. 4 is a schematic diagram showing control of the outboard motor.

When the joystick 26 is tilted rightward or leftward, the watercraft operating controller 30 moves the watercraft 100 transversely rightward or leftward (swaying mode). For example, when the joystick 26 is tilted rightward, as shown in FIG. 4, the watercraft operating controller 30 controls the thrust and the rudder angle of each outboard motor 1*a*, 1*b* such that a net force (F3) of the thrust (F1) of the outboard motor 1*a* and the thrust (F2) of the outboard motor 1*b* is oriented to the right side of the watercraft 100. Although not shown in the drawings, when the joystick 26 is tilted leftward, the watercraft operating controller 30 controls the thrust and the rudder angle of each outboard motor 1*a*, 1*b* such that the net force (F3) of the thrust (F1) of the outboard motor 1*a* and the thrust (F2) of the outboard motor 1*b* is oriented to the left side of the watercraft 100.

The watercraft operating controller 30 controls each drive unit 2*a*, 2*b*, each shift actuator 7*a*, 7*b*, and each steering actuator 8*a*, 8*b* such that the watercraft 100 turns the bow at a velocity corresponding to the twist amount of the joystick 26 in a direction corresponding to the twist direction of the joystick 26 (bow turning mode). For example, the watercraft operating controller 30 causes one of the outboard motors 1*a* and 1*b* to generate the thrust in the forward moving direction and causes the other of the outboard motors 1*a* and 1*b* to generate the thrust in the rearward moving direction such that the watercraft 100 turns the bow.

The watercraft operating system includes a position sensor 31. The position sensor 31 detects a position of the watercraft 100. The position sensor 31 is, for example, a GNSS (Global Navigation Satellite System) receiver such as a GPS (Global Positioning System) receiver. It should be noted that the position sensor 31 may be a type of sensor other than the GNSS receiver. The position sensor 31 outputs a signal indicating the position of the watercraft 100. The watercraft operating controller 30 is connected to the position sensor 31 in a communicable manner. The watercraft operating controller 30 obtains the position of the watercraft 100 based on the signal received from the position sensor 31. Additionally, the watercraft operating controller 30 obtains a speed of the watercraft 100 based on the signal received from the position sensor 31. The watercraft operating system may include another type of sensor to detect the speed of the watercraft 100.

The watercraft operating system includes a direction sensor 32. The direction sensor 32 detects a course of the watercraft 100. The direction sensor 32 is, for instance, an IMU (Inertial Measurement Unit). It should be noted that the direction sensor 32 may be a type of sensor other than the IMU. The watercraft operating controller 30 is connected to the direction sensor 32 in a communicable manner. The watercraft operating controller 30 obtains the course of the watercraft 100 based on a signal received from the direction sensor 32.

The input 27 is operable by the operator to select one of control modes of each outboard motor 1*a*, 1*b*. The input 27 is, for instance, a touchscreen. Alternatively, the input 27 may be a switch. The input 27 may be disposed on either the remote controller 25 or the joystick 26. Alternatively, the input 27 may be disposed in a position separate from each of the remote controller 25 and the joystick 26. The input 27 outputs a command signal indicating the control mode selected by the operator.

The control modes include a fixed location maintaining mode. In the fixed location maintaining mode, the watercraft operating controller 30 controls each outboard motor 1*a*, 1*b* such that the watercraft 100 is maintained at a predetermined location. For example, in the fixed location maintaining mode, the watercraft operating controller 30 controls each outboard motor 1*a*, 1*b* such that the watercraft 100 is maintained on the spot in selection of the fixed location maintaining mode. Alternatively, in the fixed location maintaining mode, the watercraft operating controller 30 may control each outboard motor 1*a*, 1*b* such that the watercraft 100 is maintained at a location specified by the input 27.

Figure 5:
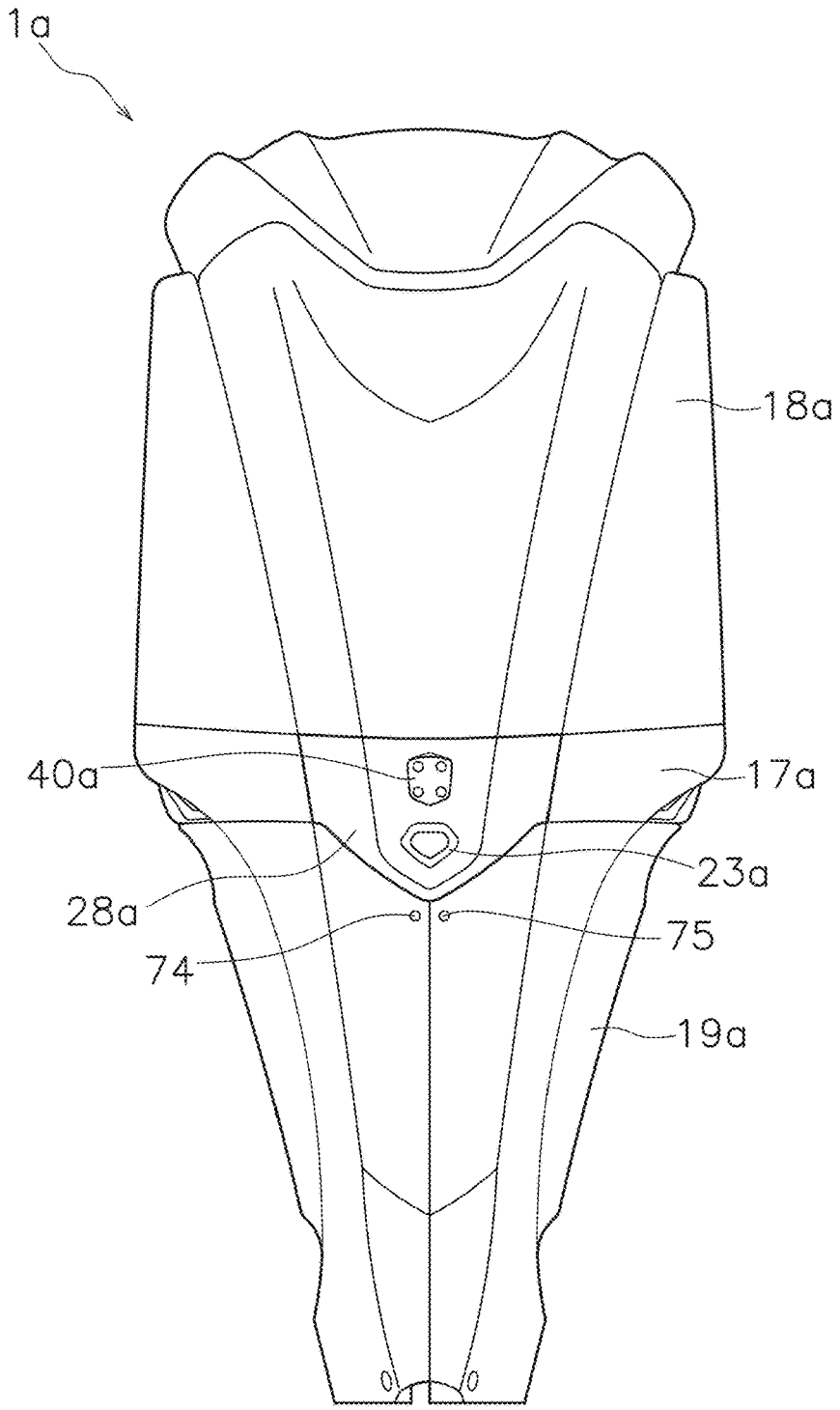
FIG. 5 is a rear view of the outboard motor.
Figure 6:
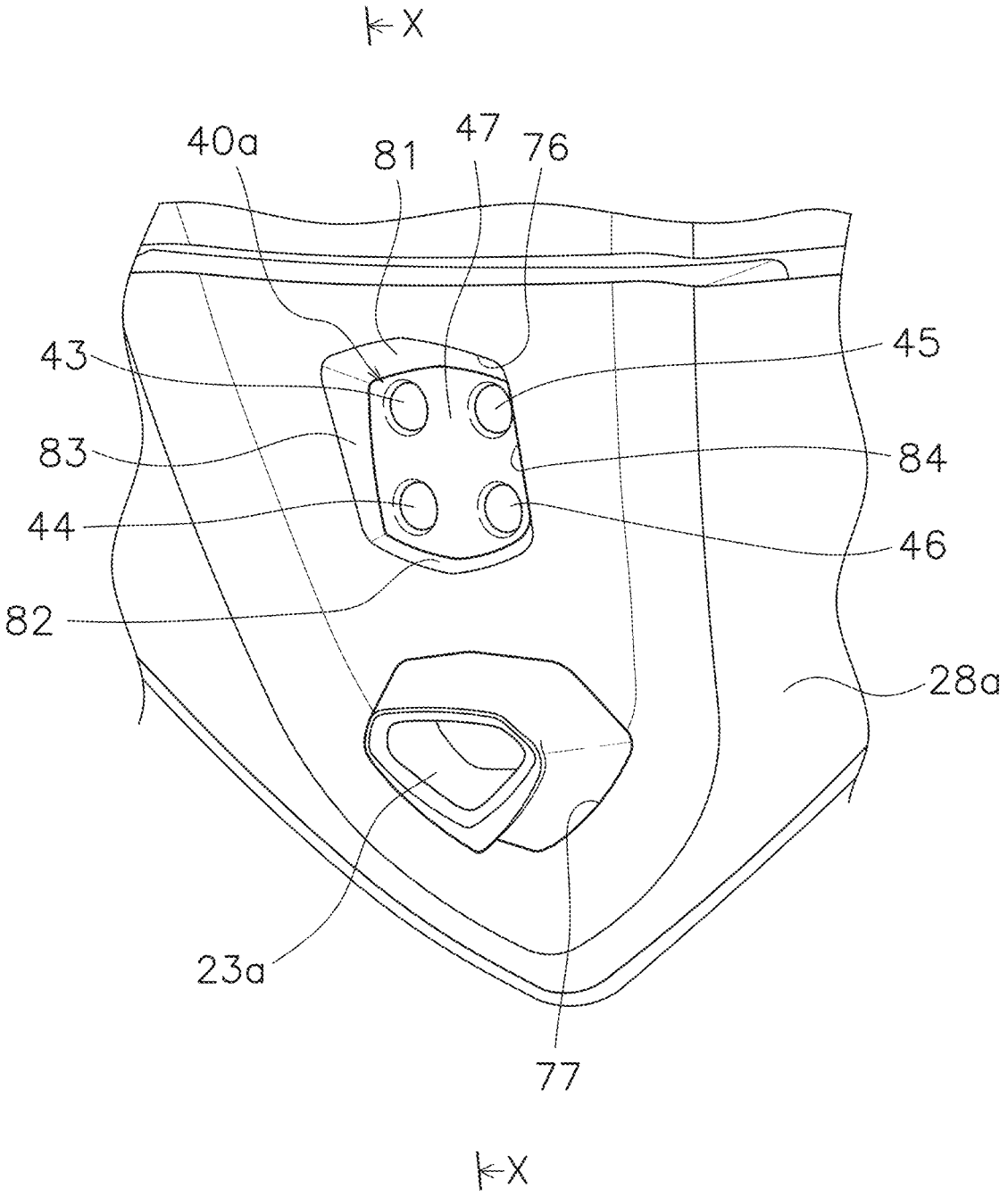
FIG. 6 is a perspective view of a rear part of the outboard motor.
Figure 7:
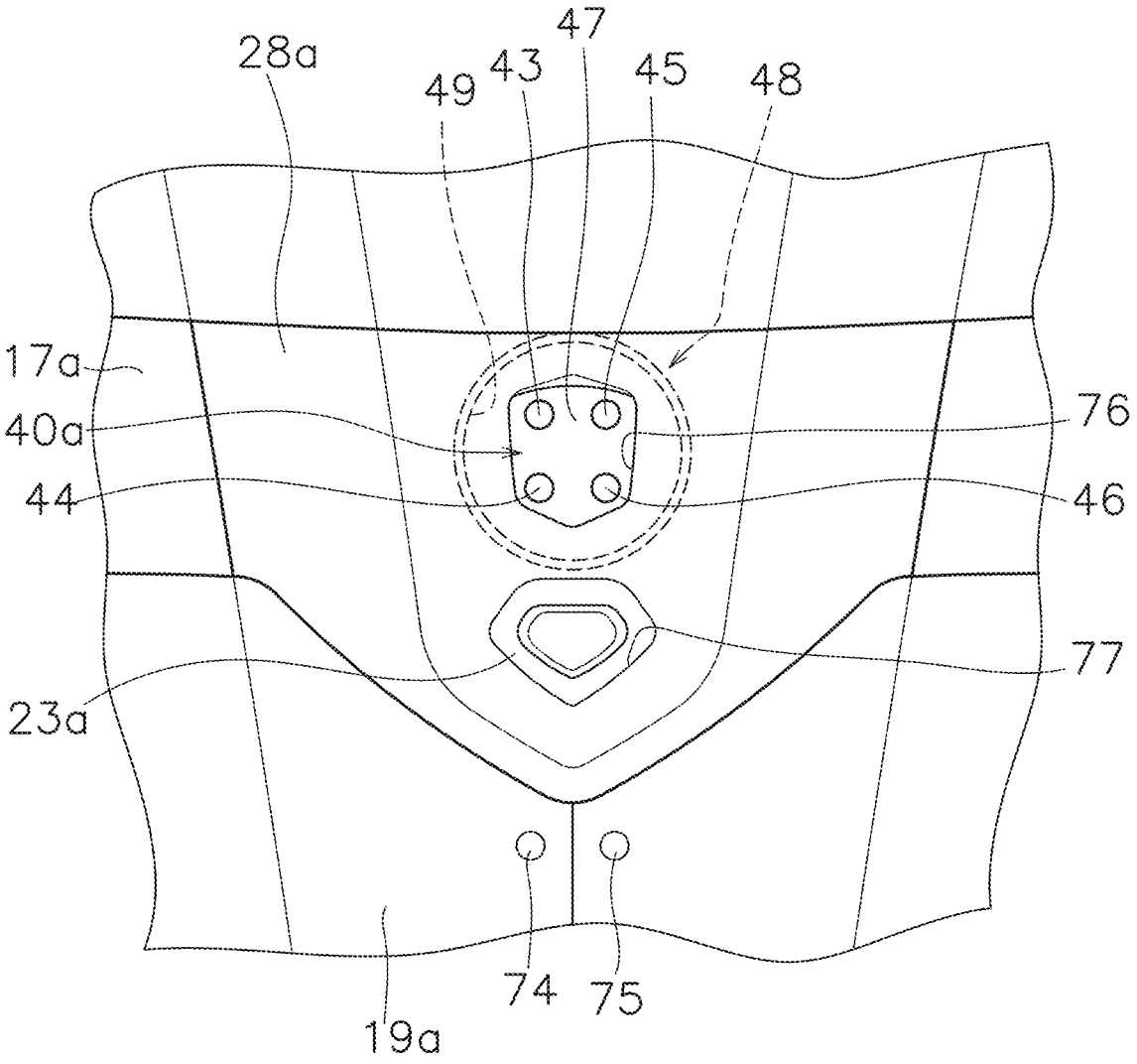
FIG. 7 is an enlarged view of the rear part of the outboard motor.

FIG. 5 is a rear view of the outboard motor 1*a*. FIG. 6 is a perspective view of a rear portion of the outboard motor 1*a*. FIG. 7 is an enlarged view of the rear portion of the outboard motor 1*a*. As shown in FIGS. 5 to 7, the outboard motor 1*a* includes a light unit 40*a*. The light unit 40*a* is disposed on the rear surface of the housing 10*a*. The light unit 40*a* is disposed on the rear surface of the bottom cowling 17*a*. The light unit 40*a* is located above the exhaust port 23*a*.

Figure 8:
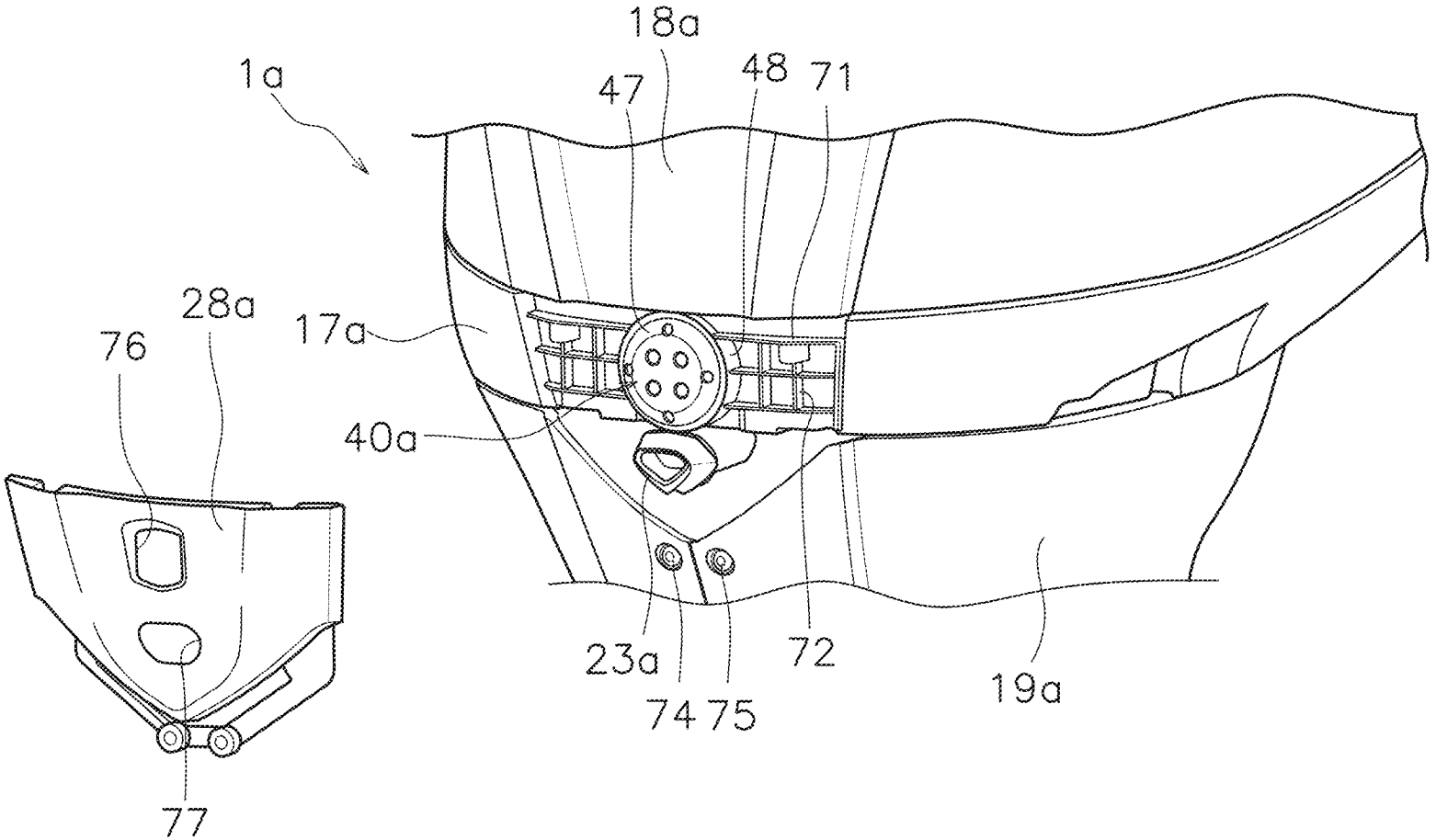
FIG. 8 is an exploded perspective view of an exterior cover, a light unit, and a bottom cowling.
Figure 9:
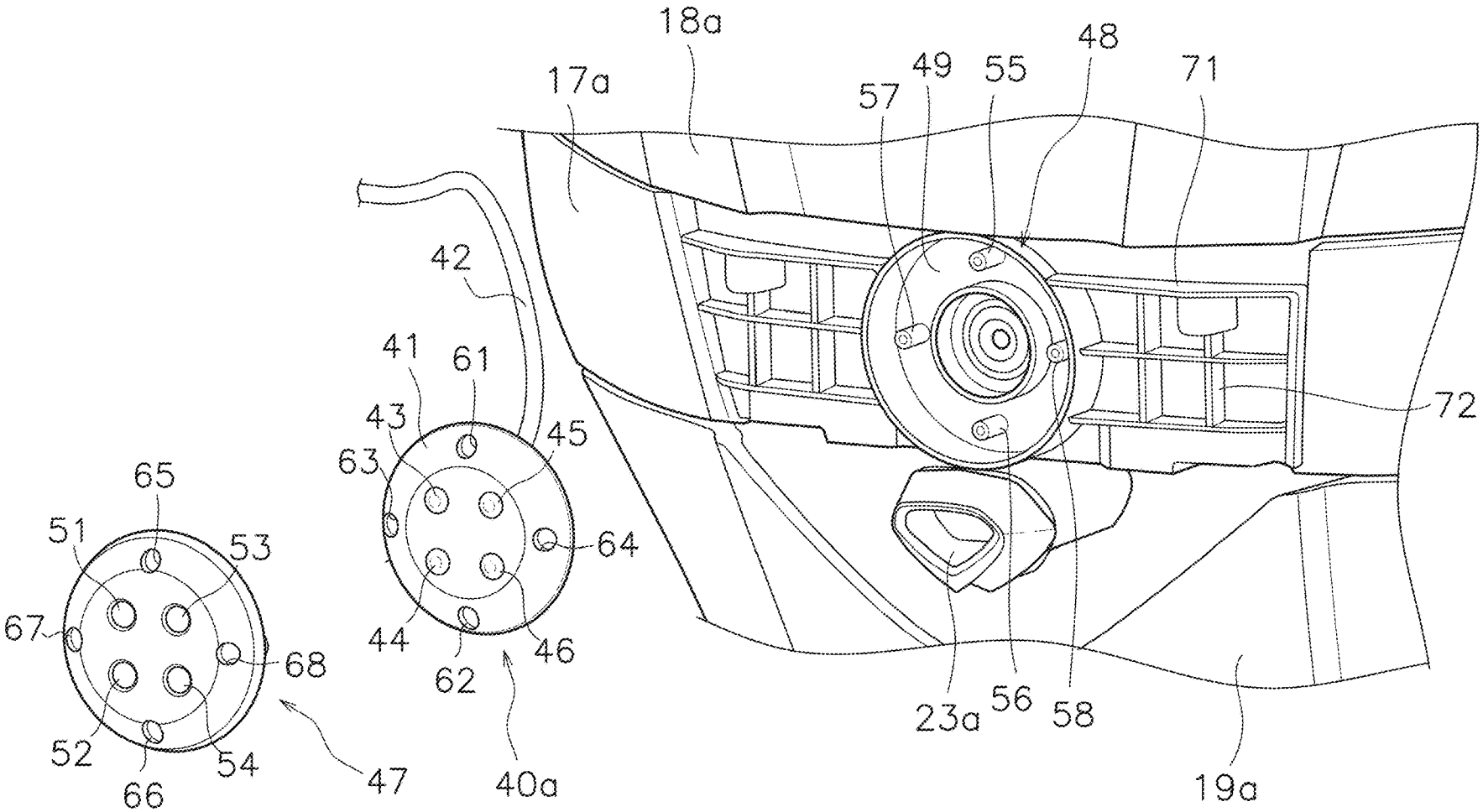
FIG. 9 is an exploded perspective view of the light unit and the bottom cowling.

An exterior cover 28*a* is attached to the bottom cowling 17*a*. FIG. 8 is an exploded perspective view of the exterior cover 28*a*, the light unit 40*a*, and the bottom cowling 17*a*. FIG. 9 is an exploded perspective view of the light unit 40*a* and the bottom cowling 17*a*. As shown in FIG. 9, the light unit 40*a* includes a light body 41 and an electric cable 42. The light body 41 may have a circular or substantially circular contour, for example. The light body 41 includes a plurality of light sources 43 to 46. The light sources 43 to 46 are, for instance, LEDs (Light-Emitting Diodes) or light bulbs. The plurality of light sources 43 to 46 include first to fourth light sources 43 to 46. The first to fourth light sources 43 to 46 are aligned both up and down and right and left. It should be noted that the number of light sources is not limited to four. The number of light sources may be less than or greater than four.

The electric cable 42 is connected to the light body 41. The electric cable 42 is connected to the first drive controller 9*a*. The watercraft operating controller 30 transmits the command signal to the light unit 40*a* through the first drive controller 9*a*. The watercraft operating controller 30 turns on the plurality of light sources 43 to 46 in a lighting pattern depending on an operating state of the outboard motor 1*a*. For example, the watercraft operating controller 30 blinks the light sources 43 to 46 in a specific pattern while the outboard motor 1*a* is operating in the fixed location maintaining mode.

A light cover 47 is attached to the light unit 40*a*. Similarly to the light body 41, the light cover 47 may have a circular or substantially circular contour, for example. The light cover 47 covers the light body 41. The light cover 47 is preferably made of an opaque material. For example, the light cover 47 is made of rubber. The light cover 47 includes a plurality of light holes 51 to 54. The plurality of light holes 51 to 54 are aligned with the plurality of light sources 43 to 46, respectively. The plurality of light holes 51 to 54 include first to fourth light holes 51 to 54. The first to fourth light holes 51 to 54 are aligned with the first to fourth light sources 43 to 46, respectively. Light is irradiated from the first to fourth light sources 43 to 46 to outside the outboard motor 1*a* through the first to fourth light holes 51 to 54. The light cover 47 prevents leakage of light irradiated from the first to fourth light sources 43 to 46 through any portion other than the first to fourth light holes 51 to 54.

As shown in FIG. 9, the bottom cowling 17*a* includes a mount 48. The light unit 40*a* is attached to the mount 48. The mount 48 is disposed on the rear surface of the bottom cowling 17*a*. The mount 48 is integral with the bottom cowling 17*a*. The mount 48 is located above the exhaust port 23*a*. The exhaust port 23*a* is located below the bottom cowling 17*a*.

The mount 48 includes a recess 49. The recess 49 is shaped along the contour of the light unit 40*a*. The recess 49 preferably includes a circular edge. The light unit 40*a* and the light cover 47 are disposed within the recess 49. The mount 48 includes a plurality of bosses 55 to 58. The plurality of bosses 55 to 58 are disposed within the recess 49. The light unit 40*a* is fixed to the plurality of bosses 55 to 58. The plurality of bosses 55 to 58 include first to fourth bosses 55 to 58. The light unit 40*a* includes first to fourth fixed holes 61 to 64. The first to fourth fixed holes 61 to 64 are disposed radially outside the first to fourth light sources 43 to 46. The first to fourth bosses 55 to 58 are aligned with the first to fourth fixed holes 61 to 64, respectively. The light cover 47 includes first to fourth holes 65 to 68. The first to fourth holes 65 to 68 are disposed radially outside the first to fourth light holes 51 to 54. The first to fourth holes 65 to 68 are aligned with the first to fourth fixed holes 61 to 64, respectively.

Figure 10:
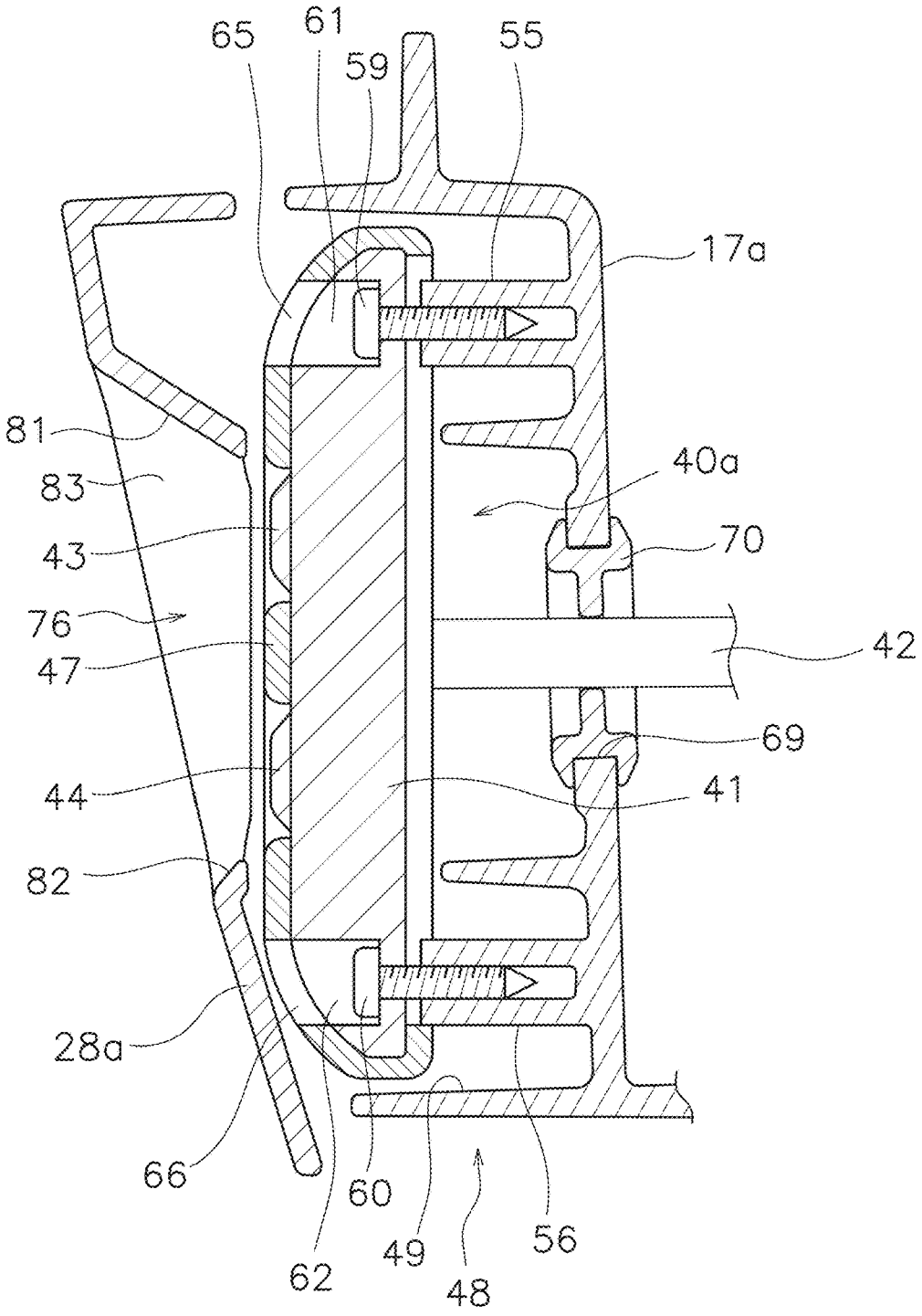
FIG. 10 is a cross-sectional view of FIG. 6 taken along line X-X.

FIG. 10 is a cross-sectional view of FIG. 6 taken along line X-X. As shown in FIG. 10, a first connector 59 is inserted through the first fixed hole 61 and the first boss 55. A second connector 60 is inserted through the second fixed hole 62 and the second boss 56. Although not shown in the drawings, a third connector is inserted through the third fixed hole 63 and the third boss 57, while a fourth connector is inserted through the fourth fixed hole 64 and the fourth boss 58. Accordingly, the light unit 40*a* is fixed to the mount 48. The connectors are, for instance, screws.

As shown in FIG. 10, the mount 48 includes a cable hole 69. The cable hole 69 penetrates the bottom cowling 17*a*. The electric cable 42 is inserted through the cable hole 69. A seal 70 is attached to the cable hole 69. The seal 70 is made of an elastic material such as rubber. The seal 70 seals between the electric cable 42 and the edge of the cable hole 69. The seal 70 prevents water from intruding into the bottom cowling 17*a* through the cable hole 69.

As shown in FIG. 9, the bottom cowling 17*a* includes a plurality of reinforcing ribs 71 and 72. It should be noted that in FIG. 9, reference numerals are assigned to only some of the plurality of reinforcing ribs 71 and 72 without being assigned to the rest of the plurality of reinforcing ribs 71 and 72. The plurality of reinforcing ribs 71 and 72 are located around the mount 48. The reinforcing ribs 71 and 72 are disposed on the right and left of the mount 48. The reinforcing ribs 71 extend in the right-and-left direction. The reinforcing ribs 71 are connected to the mount 48. The reinforcing ribs 71 extend right and left from the mount 48. The reinforcing ribs 72 extend in the up-and-down direction.

Figure 11:
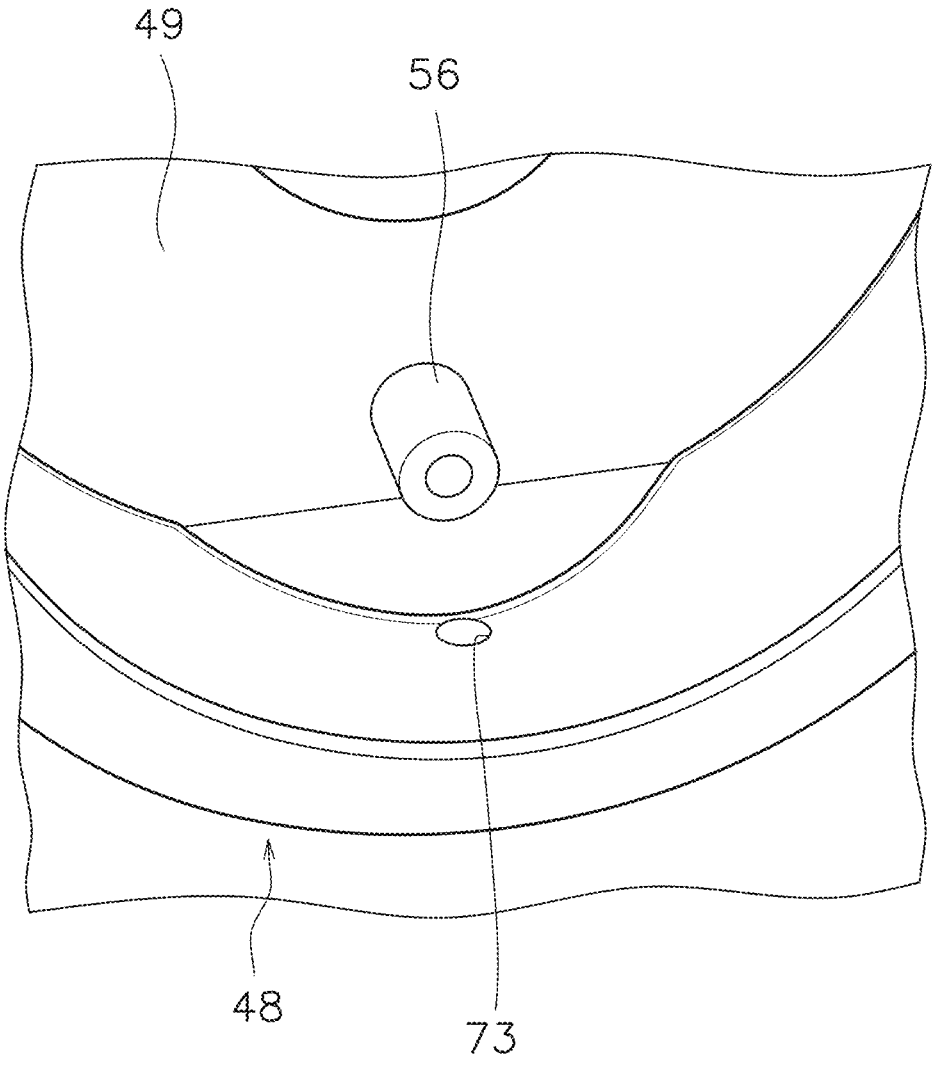
FIG. 11 is an enlarged view of a mount.

FIG. 11 is an enlarged view of the mount 48. As shown in FIG. 11, the bottom cowling 17*a* includes a water draining hole 73. The water draining hole 73 is disposed within the mount 48. The water draining hole 73 is disposed in a bottom portion of the mount 48. The water draining hole 73 penetrates the mount 48 in the up-and-down direction. Water, when inside the mount 48, is discharged to outside the bottom cowling 17*a* through the water draining hole 73.

The exterior cover 28*a* is attached to the bottom cowling 17*a* in a detachable manner. As shown in FIG. 5, the exterior cover 28*a* is fixed to the upper casing 19*a* by bolts 74 and 75, for example. As shown in FIG. 8, the exterior cover 28*a* includes a first opening 76 and a second opening 77. The first opening 76 is aligned with the light unit 40*a*. The second opening 77 is located below the first opening 76. The second opening 77 is aligned with the exhaust port 23*a*.

As seen in the rear view of the outboard motor 1*a* shown in FIG. 7, the first opening 76 is smaller in contour than the light unit 40*a*. As seen in the rear view of the outboard motor 1*a*, the exterior cover 28*a* overlaps the mount 48. The first to fourth light sources 43 to 46 are disposed within the first opening 76. The first to fourth light sources 43 to 46 are visible through the first opening 76. As seen in the rear view of the outboard motor 1*a*, the exterior cover 28*a* overlaps the reinforcing ribs 71 and 72.

As shown in FIG. 6, the light unit 40*a* is spaced apart from the outer surface of the exterior cover 28*a* toward the inside of the housing 10*a*. The exterior cover 28*a* includes the inner surface of the first opening 76. The inner surface of the first opening 76 extends from the outer surface of the exterior cover 28*a* to the light unit 40*a*. The inner surface of the first opening 76 slants toward the outer surface of the exterior cover 28*a*. Accordingly, light irradiated from the first to fourth light sources 43 to 46 is visible from a wide range of positions behind the outboard motor 1*a*.

More specifically, the inner surface of the first opening 76 includes a first slope 81, a second slope 82, a third slope 83, and a fourth slope 84. The first slope 81 is located above the light unit 40*a*. The second slope 82 is located below the light unit 40*a*. The third slope 83 is located on the left of the light unit 40*a*. The fourth slope 84 is located on the right of the light unit 40*a*. The first slope 81 slants upward toward the outer surface of the exterior cover 28*a*. The second slope 82 slants downward toward the outer surface of the exterior cover 28*a*. The third slope 83 slants laterally outward toward the outer surface of the exterior cover 28*a*. The fourth slope 84 slants laterally outward toward the surface of the exterior cover 28*a*.

In the outboard motor 1*a* according to the first preferred embodiment of the present invention explained above, the light unit 40*a* is attached at a highly visible position. Additionally, turning on the light unit 40*a* enables a person or people around the watercraft 100 to easily understand which of the control modes is being executed. It should be noted that, as shown in FIG. 3, the outboard motor 1*b* includes a light unit 40*b*. The light unit 40*b* is similar in structure and position to the light unit 40*a*.

Figure 12:
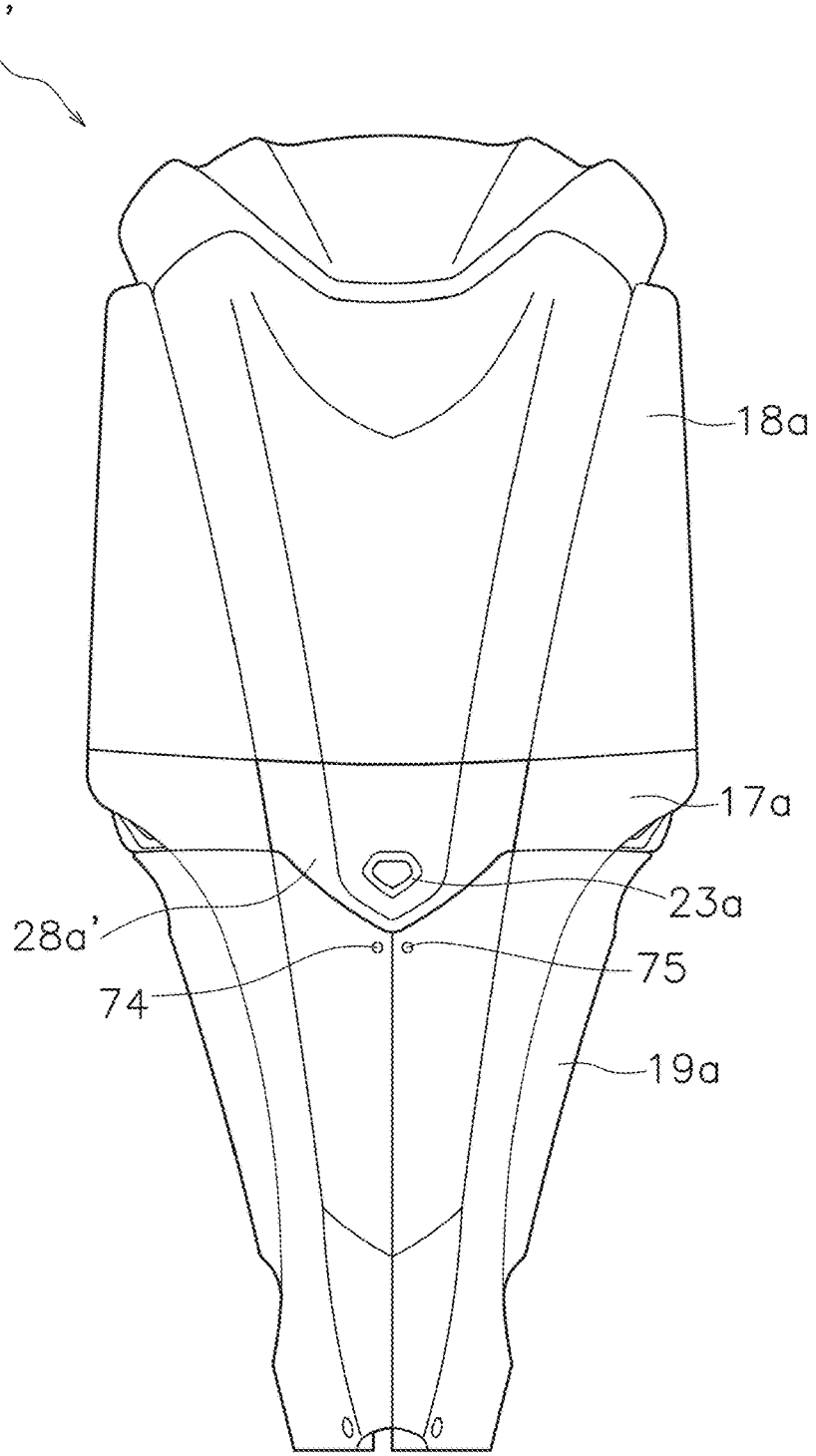
FIG. 12 is a rear view of an outboard motor according to a second preferred embodiment of the present invention.
Figure 13:
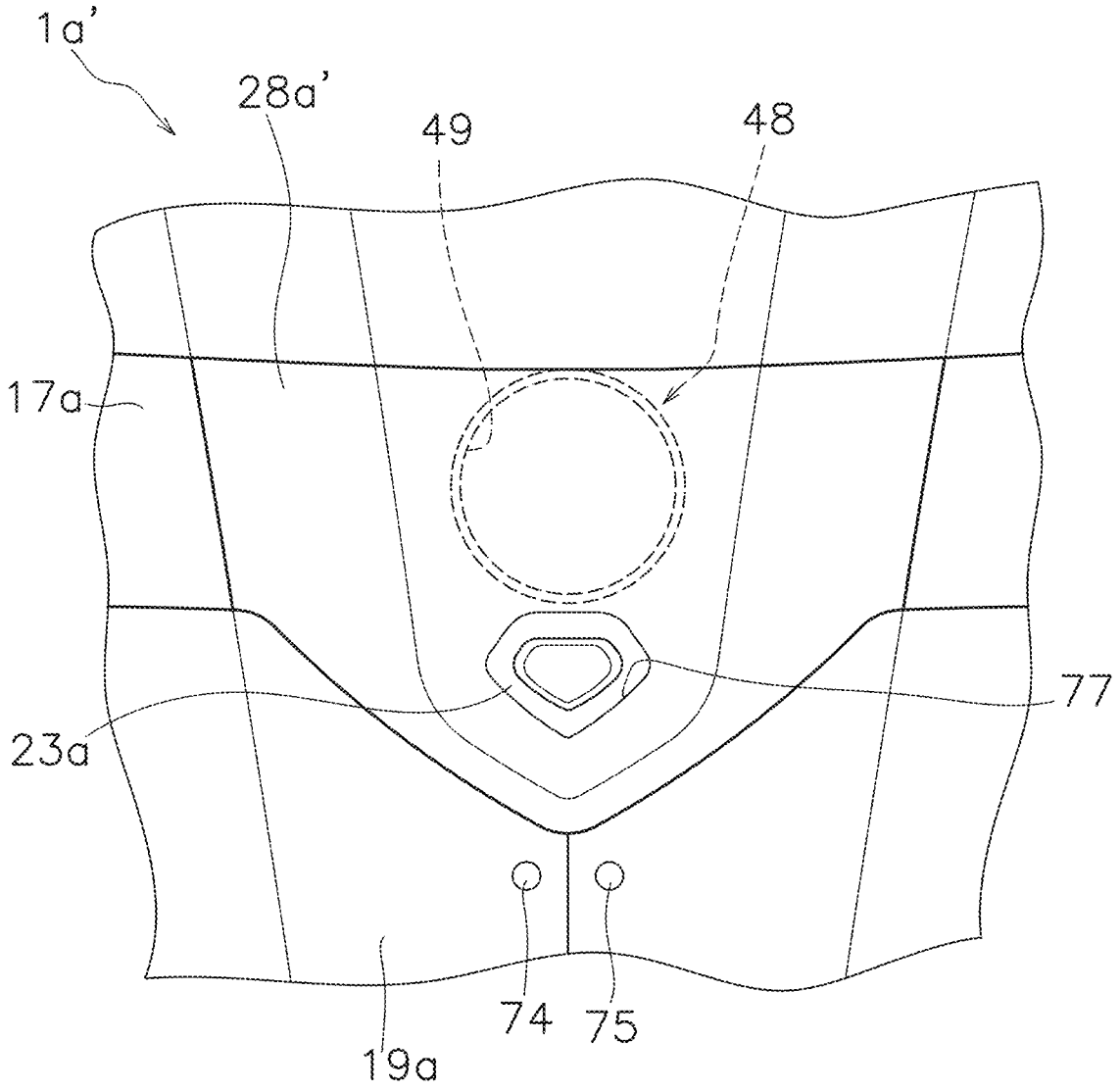
FIG. 13 is an enlarged view of a rear part of the outboard motor according to the second preferred embodiment of the present invention.

Next, an outboard motor 1*a*' according to a second preferred embodiment of the present invention will be explained. FIG. 12 is a rear view of the outboard motor 1*a*' according to the second preferred embodiment. FIG. 13 is an enlarged view of a rear portion of the outboard motor 1*a*'. The outboard motor 1*a*' does not include the light unit 40*a* and the light cover 47. It should be noted that the outboard motor 1*a*' includes the mount 48 similar to that in the outboard motor 1*a* according to the first preferred embodiment. As shown in FIG. 13, the outboard motor 1*a*' includes an exterior cover 28*a*'. The exterior cover 28*a*' is not provided with the first opening 76. Therefore, the exterior cover 28*a*' covers the mount 48 such that the mount 48 is invisible from outside the outboard motor 1*a*'. Except for the exterior cover 28*a*', the outboard motor 1*a*' is similar in structure to the outboard motor 1*a* according to the first preferred embodiment.

The outboard motor 1*a*' according to the second preferred embodiment described above includes the mount 48 for the light unit 40*a*. Because of this, the light unit 40*a* is easily attached to a highly visible position on the outboard motor 1*a*' at an arbitrary later point in time.

Preferred embodiments of the present invention have been explained above. However, the present invention is not limited to the preferred embodiments described above, and a variety of changes can be made without departing from the gist of the present invention.

The structure of each outboard motor is not limited to that in each of the preferred embodiments described above and may be changed. For example, the drive unit 2*a* is not limited to the internal combustion engine, and alternatively, may be an electric motor. Yet alternatively, the drive unit 2*a* may be a hybrid watercraft operating system of an internal combustion engine and an electric motor.

Figure 15:
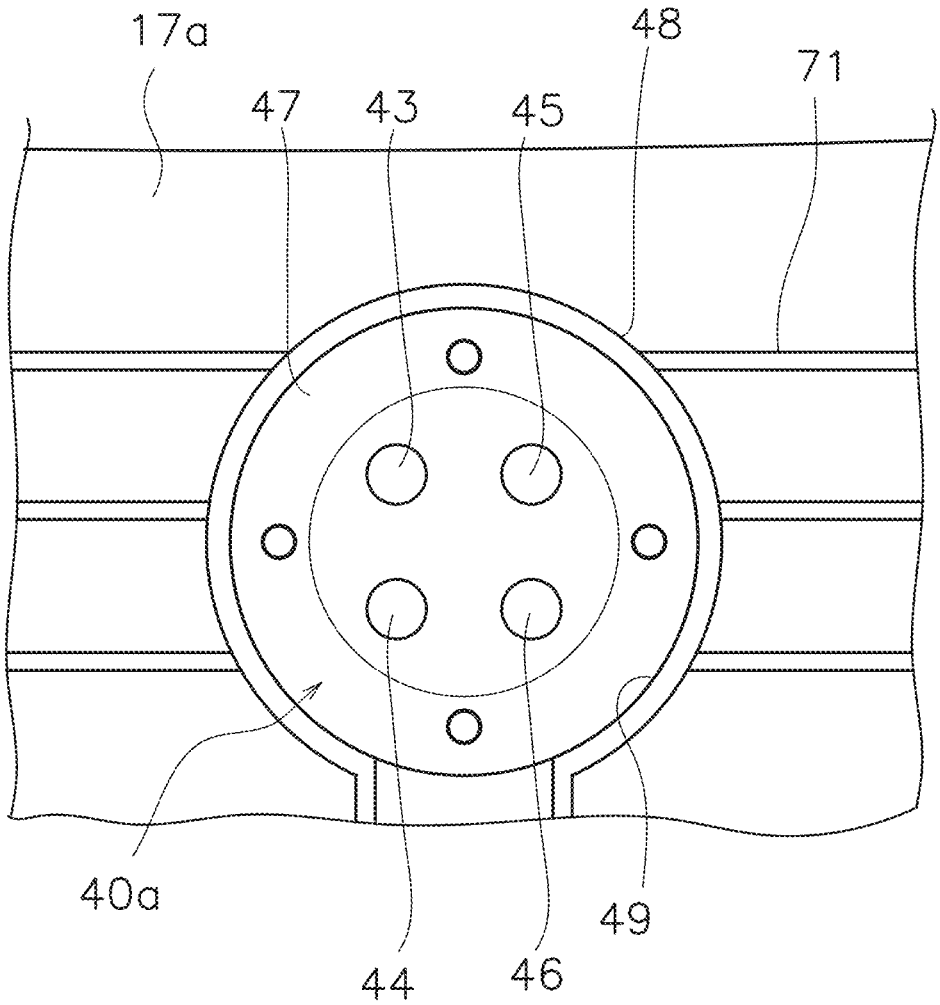
FIG. 15 is a diagram showing a modification of the mount.

The shape or position of the mount 48 is not limited to that in each of the preferred embodiments described above and may be changed. The mount 48 may be disposed on a portion of the housing 10*a* other than the bottom cowling 17*a*. For example, the mount 48 may be disposed on the top cowling 18*a*. Alternatively, the mount 48 may be disposed on the upper casing 19*a*. The shape of the mount 48 is not limited to the circular shape, and alternatively, may be another shape such as an oval shape. For example, as shown in FIG. 15, the mount 48 may have a shape to open at a lower portion thereof. The shape of the recess 49 is not limited to the circular shape, and alternatively, may be another shape such as an oval shape. The number or layout of bosses is not limited to that in each of the preferred embodiments described above and may be changed. The mount 48 may not be necessarily integral with the bottom cowling 17*a*, and alternatively, may be separate therefrom. For example, the mount 48 may be attached to the bottom cowling 17*a* or another portion through a bracket.

The shape or position of the light unit is not limited to that in each of the preferred embodiments described above and may be changed. The shape of the light unit is not limited to the circular or substantially circular shape, and alternatively, may be another shape. The number or layout of the light sources is not limited to that in each of the preferred embodiments described above and may be changed. The number or layout of the fixed holes is not limited to that in each of the preferred embodiments described above and may be changed.

The shape or position of the light cover is not limited to that in each of the preferred embodiments described above and may be changed. The shape of the light cover is not limited to the circular shape, and alternatively, may be another shape. The number or layout of the light holes is not limited to that in each of the preferred embodiments described above and may be changed. The number or layout of the holes is not limited to that in each of the preferred embodiments described above and may be changed. The light cover may be made of material other than rubber such as resin. The light cover may be omitted.

The watercraft operating controller 30 may turn on the light sources in an operating state other than that the control mode is being executed. For example, the watercraft operating controller 30 may turn on the light sources when starting the engine. The watercraft operating controller 30 may turn on the light sources during driving of the engine. The watercraft operating controller 30 may turn on the light sources depending on the operating states of the outboard motor 1*a* such as forward movement, rearward movement, and turning.

Figure 14:
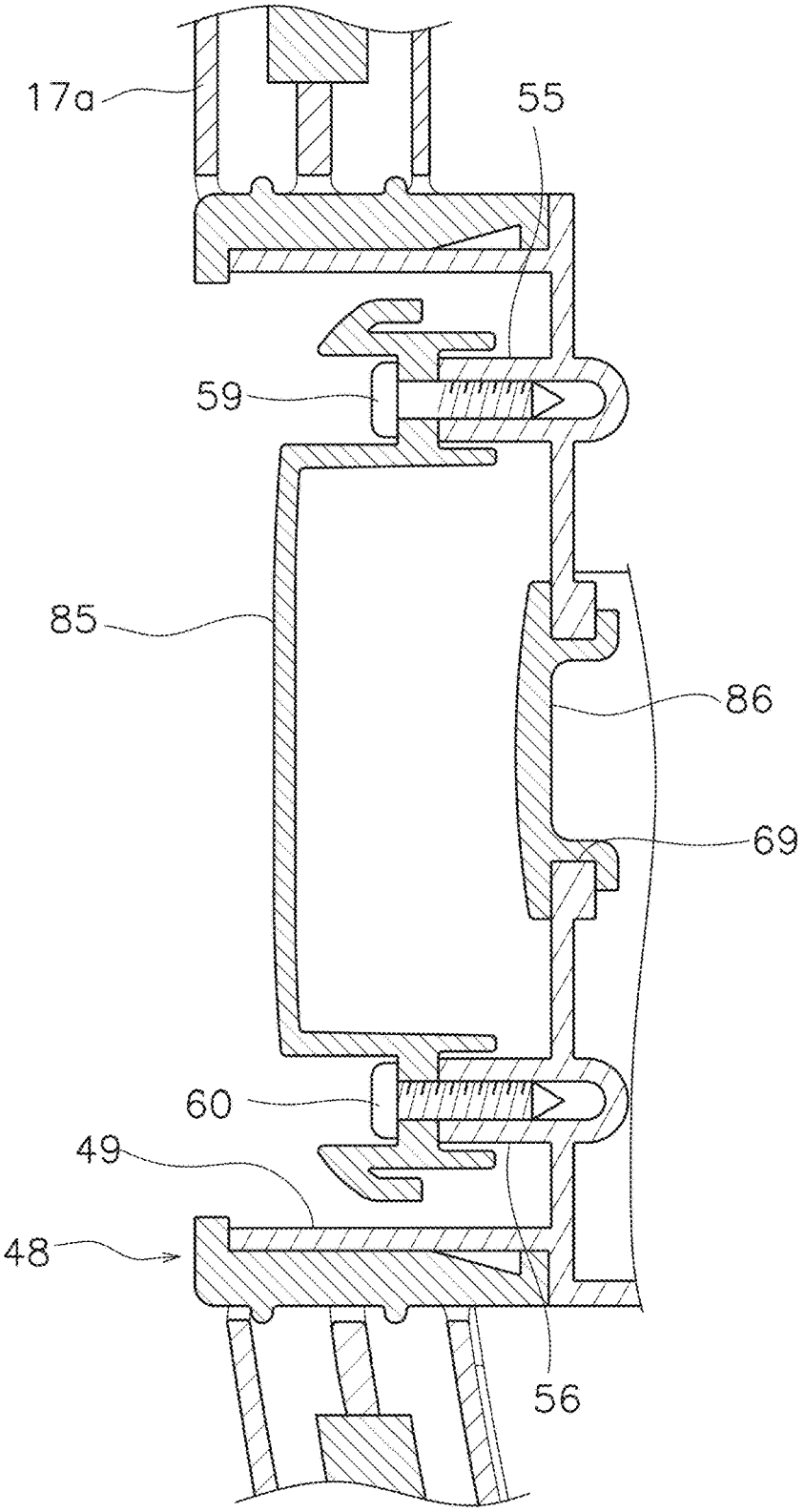
FIG. 14 is a cross-sectional view of a modification of the outboard motor according to the second preferred embodiment of the present invention.

FIG. 14 is a cross-sectional view of a modification of the outboard motor 1*a*' according to the second preferred embodiment. As shown in FIG. 14, the outboard motor 1*a*' may include a dummy cover 85. The dummy cover 85 is shaped along the recess 49 of the mount 48. The dummy cover 85 is attached, instead of the light unit 40*a*, to the mount 48. Additionally, a grommet 86 may be attached to the cable hole 69. The grommet 86 is made of, for instance, an elastic material such as rubber. The grommet 86 plugs the cable hole 69.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:
a propeller shaft;
a drive unit to rotate the propeller shaft;
a housing accommodating the drive unit;
a mount provided on the housing;
a light unit attached to the mount and including a plurality of light sources; and
a controller connected to the light unit and configured or programmed to turn on the plurality of light sources in a lighting pattern depending on an operating state of the outboard motor; wherein
the mount includes a recess, and the light unit is disposed in the recess; and
an outer surface of the light unit is located inside of an outer surface of the housing.

2. The outboard motor according to claim 1, wherein the mount includes a plurality of bosses to which the light unit is fixed.

3. The outboard motor according to claim 1, wherein the light unit further includes:
a light body in which the plurality of light sources are disposed; and
an electric cable connected to the light body; and
the mount includes a hole through which the electric cable is inserted.

4. The outboard motor according to claim 3, further comprising:
a seal between the electric cable and an edge of the hole.

5. The outboard motor according to claim 1, further comprising:
a light cover attached to the light unit; wherein
the light cover is opaque and includes a plurality of holes aligned with the plurality of light sources.

6. The outboard motor according to claim 1, further comprising:
an exterior cover attached to the housing and including an opening aligned with the light unit.

7. The outboard motor according to claim 6, wherein the light unit is spaced apart from an outer surface of the exterior cover toward an inside the housing.

8. The outboard motor according to claim 7, wherein
the exterior cover includes an inner surface of the opening, the inner surface extending from the outer surface of the exterior cover to the light unit; and
the inner surface of the opening slants toward the outer surface of the exterior cover.

9. The outboard motor according to claim 1, wherein
the drive unit includes an engine;
the housing includes:
a bottom cowling covering the engine; and
a top cowling attached to the bottom cowling; and
the mount is provided on the bottom cowling.

10. The outboard motor according to claim 1, wherein the housing includes a reinforcing rib located around the mount.

11. An outboard motor comprising:
a propeller shaft;
a drive unit to rotate the propeller shaft;
a housing accommodating the drive unit;
a mount provided on the housing to attach a light unit capable of being turned on in a lighting pattern depending on an operating state of the outboard motor; and
a cover attached to the housing to cover the mount; wherein
the mount includes a recess, and the light unit is disposed in the recess; and
an outer surface of the light unit is located inside of an outer surface of the housing.

12. The outboard motor according to claim 11, wherein the mount includes a plurality of bosses to fix the light unit thereto.

13. The outboard motor according to claim 11, wherein the mount includes a hole to insert an electric cable of the light unit therethrough.

14. The outboard motor according to claim 13, further comprising:
a grommet to plug the hole.

15. The outboard motor according to claim 11, wherein
the drive unit includes an engine;
the housing includes:
a bottom cowling covering the engine; and
a top cowling attached to the bottom cowling; and
the mount is provided on the bottom cowling.

16. The outboard motor according to claim 11, wherein the housing includes a reinforcing rib located around the mount.

17. An outboard motor comprising:
a propeller shaft;
a drive unit to rotate the propeller shaft and including an engine;
a housing accommodating the drive unit;
an exhaust pathway connected to the engine and including an exhaust port exposed from the housing to an outside of the outboard motor;
a mount provided on the housing and located above the exhaust port;
a light unit attached to the mount and including a plurality of light sources; and
a controller connected to the light unit and configured or programmed to turn on the plurality of light sources in a lighting pattern depending on an operating state of the outboard motor; wherein
the mount includes a recess, and the light unit is disposed in the recess; and
an outer surface of the light unit is located inside of an outer surface of the housing.

* * * * *